United States Patent [19]

Demi

[11] 4,342,886

[45] Aug. 3, 1982

[54] BURNER VALVE CONTROL DEVICE, AN ELECTRICAL SWITCH UNIT THEREFOR AND METHODS OF MAKING THE SAME

[75] Inventor: Roy C. Demi, Greensburg, Pa.

[73] Assignee: Robertshaw Controls Company, Richmond, Va.

[21] Appl. No.: 74,157

[22] Filed: Sep. 10, 1979

[51] Int. Cl.[3] ..... H01H 9/06

[52] U.S. Cl. ..... 200/61.86

[58] Field of Search ..... 200/61.81, 61.86, 294, 200/295, 296; 431/256, 257

[56] References Cited

U.S. PATENT DOCUMENTS

| | | | |
|---|---|---|---|
| 3,122,616 | 2/1964 | Rice et al. | 200/61.86 |
| 3,727,021 | 4/1973 | Preis | 200/295 X |
| 3,887,777 | 6/1975 | Nishino | 200/295 X |
| 4,002,872 | 1/1977 | Desio | 200/294 |
| 4,123,633 | 10/1978 | Stevens et al. | 200/61.86 |
| 4,186,762 | 2/1980 | Hardin | 200/296 X |
| 4,249,047 | 2/1981 | Huff et al. | 200/61.86 |

FOREIGN PATENT DOCUMENTS

| | | | |
|---|---|---|---|
| 2559398 | 9/1976 | Fed. Rep. of Germany | 200/295 |

*Primary Examiner*—James R. Scott

*Attorney, Agent, or Firm*—Candor, Candor & Tassone

[57] ABSTRACT

A combination of a burner valve control device and an electrical switch unit carried by the device and being operated by a movable actuator controlled by the selector of the device, the selector having a control shaft rotatable about an axis thereof. The switch unit has a snap-fit arrangement snap-fitted to the device when the entire switch unit is moved in a direction substantially transverse to the axis of the control shaft to detachably secure the switch unit to the device.

10 Claims, 15 Drawing Figures

BURNER VALVE CONTROL DEVICE, AN ELECTRICAL SWITCH UNIT THEREFOR AND METHODS OF MAKING THE SAME

BACKGROUND OF THE INVENTION

1. Field of the Invention

This invention relates to an improved combination of a control device and an electrical switch unit carried thereby and to a method of making the same.

This invention also relates to an improved electrical switch unit for such a device or the like and to improved parts for such an electrical switch unit or the like as well as to improved methods of making such switch units and parts therefor.

2. Prior Art Statement

It is known to provide a combination of a burner valve control device and an electrical switch unit carried thereby to be operated by movable actuator means controlled by the selector means of the device whereby turning the selector means to a certain position thereof will cause the electrical switch to operate electrical ignition means to ignite fuel being controlled by the burner valve control device.

In one such prior known arrangement, the electrical switch unit is fastened by conventional fastening means to the rear of the housing of the burner valve control device and an elongated bell-crank-like member is pivotally carried by the housing of the control device and extends from the selector means thereof to the electrical switch to operate the same.

It is also known to provide an electrical switch construction having a housing means carrying a pair of switch blades therein and respectively having contact portions for engaging each other, the housing means carrying an actuating member for engaging one of the switch blades to thereby move the contact portion thereof out of contact with the contact portion of the other of the switch blades.

It is also known to provide a switch blade construction for an electrical switch construction wherein the switch blade construction has a flexible end switching portion and an opposed rigid terminal portion, the terminal portion comprising a separate rigid member secured to a flexible switch blade that forms the flexible end switching portion.

SUMMARY OF THE INVENTION

It is a feature of this invention to provide an improved combination of a burner valve control device and an electrical switch unit carried thereby.

In particular, it was found according to the teachings of this invention, that a unique snap-fit arrangement can be provided for the burner valve control device and the electrical switch unit so that the electrical switch unit can be snap-fitted to the device so as to be detachably secured thereto.

Accordingly, one embodiment of this invention provides a combination of a burner valve control device and an electrical switch unit carried by the device and being operated by movable actuator means controlled by the selector means of the device, the switch unit having snap-fit means snap-fitted to the device when the entire switch unit is moved in a direction substantially transverse to the axis of rotation of a control shaft of the selector means to detachably secure the switch unit to the device.

It is another feature of this invention to provide an improved actuator means for actuating the switch means of the switch unit that is carried by the burner valve control device and is operated by the selector means thereof.

In particular, it is found according to the teachings of this invention that a bell-crank-like lever can be pivotally mounted to the switch unit to be carried thereby and still provide means whereby the selector means of the burner valve control device can operate the same.

Accordingly, an embodiment of this invention provides a combination of a burner valve control device and an electrical switch unit carried by the device and having the switch means thereof operated by movable actuator means that is, in turn, operated by the selector means of the device, the movable actuator means comprising a bell-crank-like lever pivotally mounted to the switch unit to be carried thereby and having an actuator arm engageable with the selector means of the device and the switch means of the switch unit.

It is another feature of this invention to provide an improved electrical switch construction.

In particular, it was found according to the teachings of this invention that the switch blades of a switch construction can be uniquely arranged so that one switch blade is mounted intermediate another switch blade and an actuator means operates the outboard switch blade in a unique manner.

For example, an embodiment of this invention provides an electrical switch construction having a housing means carrying a pair of switch blades therein and respectively having contact portions for engaging each other, the housing means carrying an actuator member for engaging and moving one of the switch blades to thereby move the contact portion thereof out of contact with the contact portion of the other of the switch blades. The other switch blade is disposed intermediate the one switch blade and the actuator member and the one switch blade has an end looped therefrom and disposed intermediate the other switch blade and the actuator member to be engaged by the actuator member.

It is another feature of this invention to provide an improved switch blade for an electrical switch construction.

In particular, it was found according to the teachings of this invention that a switch blade can comprise a one-piece member and have a rigid terminal portion and a flexible switching portion.

For example, one embodiment of this invention provides a switch blade for an electrical switch construction wherein the switch blade has a flexible end switching portion and an opposed rigid terminal portion, the switch blade comprising a one-piece member having the terminal portion formed from a part of the one-piece member folded upon itself.

Accordingly, it is an object of this invention to provide an improved combination of a burner valve control device and an electrical switch unit carried by the device, the combination of this invention having one or more of the novel features of this invention as set forth above or hereinafter shown or described.

Another object of this invention is to provide a method of making a combination of a burner valve control device and an electrical switch unit carried by the device, the method of this invention having one or more of the novel features of this invention as set forth above or hereinafter shown or described.

Another object of this invention is to provide an improved electrical switch construction, the electrical switch construction of this invention having one or more of the novel features of this invention as set forth above or hereinafter shown or described.

Another object of this invention is to provide a method of making an electrical switch construction, the method of this invention having one or more of the novel features of this invention as set forth above or hereinafter shown or described.

Another object of this invention is to provide an improved switch blade for an electrical switch construction, the switch blade of this invention having one or more of the novel features of this invention as set forth above or hereinafter shown or described.

Another object of this invention is to provide a method of making a switch blade for an electrical switch construction, the method of this invention having one or more of the novel features of this invention as set forth above or hereinafter shown or described.

Other objects, uses and advantages of this invention are apparent from a reading of this description which proceeds with reference to the accompanying drawings forming a pair thereof and wherein:

DESCRIPTION OF THE PREFERRED EMBODIMENTS

Figure 1:
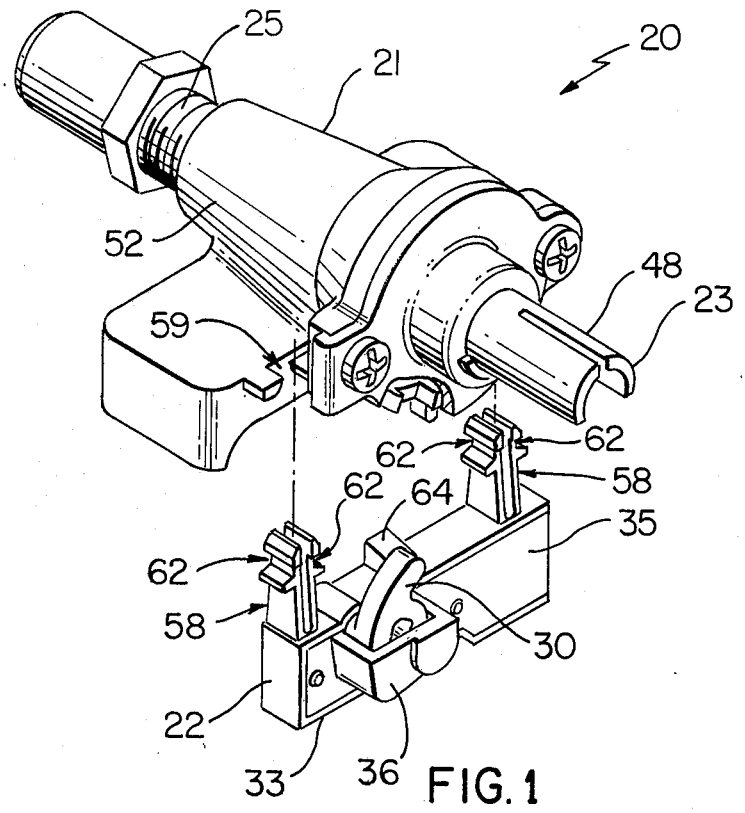
FIG. 1 is an exploded perspective view illustrating the improved combination of this invention that comprises a burner valve control device and an electrical switch unit carried by the device.

While the various features of this invention are hereinafter described and illustrated as being particularly adapted to provide an electrical switching arrangement for a burner valve control device for a top burner of a cooking apparatus or the like, it is to be understood that the various features of this invention can be utilized singly or in any combination thereof to provide devices for other structures as desired.

Therefore, this invention is not to be limited to only the embodiments illustrated in the drawings, because the drawings are merely utilized to illustrate one of the wide variety of uses of this invention.

Figure 2:
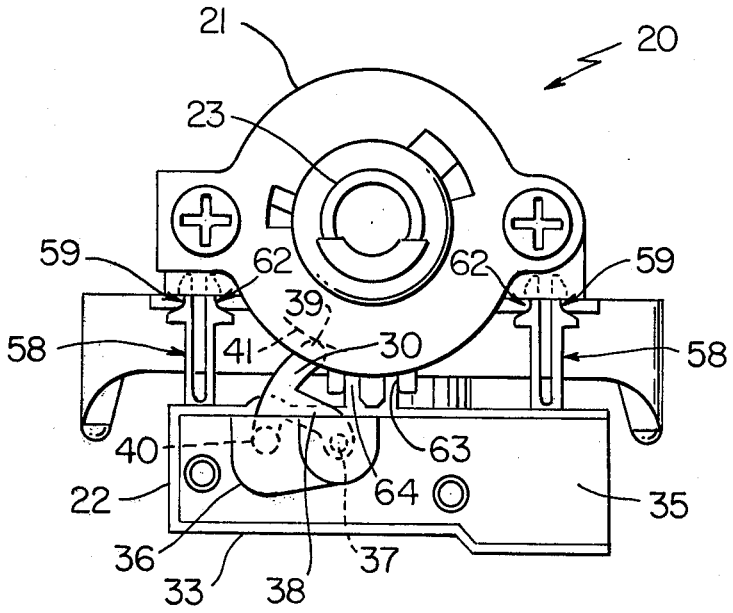
FIG. 2 is a front view of the assembled burner valve control device and the electrical switch unit of FIG. 1.

Referring now to FIGS. 1 and 2, the improved combination of this invention is generally indicated by the reference numeral 20 and comprises a burner valve control device 21 carrying an electrical switch unit 22 in a manner hereinafter set forth so that when a selector means 23 of the device 21 is turned to a certain position or positions thereof, the switch means that is generally indicated by the reference numeral 24 in FIG. 3 will be disposed in the closed condition illustrated in FIG. 3 to operate suitable electrical ignition means (not shown) to ignite fuel issuing from a top burner (not shown) of a cooking apparatus and being fed thereto by the control device 21 out of an outlet means 25 thereof in a manner well known in the art.

Figure 3:
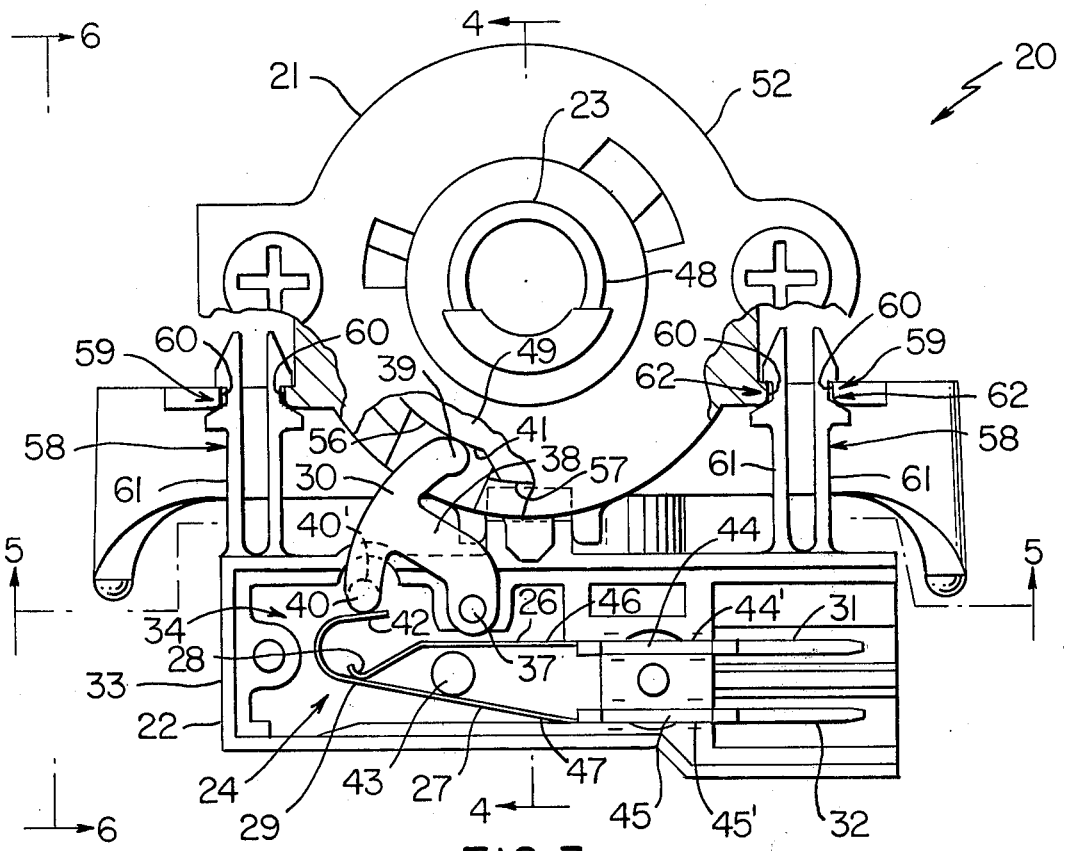
FIG. 3 is an enlarged view similar to FIG. 2 with various parts broken away and shown in cross section.

The switch means 24 of the switch unit 22 comprises a pair of switch blades 26 and 27 respectively having contact portions 28 and 29 adapted to be disposed in contact with each other when an actuator means 30 of the switch unit 22 is disposed in the position illustrated in FIG. 3 so as to electrically interconnect together terminal portions 31 and 32 of the switch blades 26 and 27 to operate the aforementioned electrical ignition means. However, when the actuator means 30 is moved to the position illustrated in FIG. 7, it can be seen that the contact portion 29 of the switch blade 27 is moved out of contact with the contact portion 28 of the switch blade 26 so as to break electrical connection between the terminal ends 31 and 32 to thereby place the electrical ignition means in an "off" condition thereof.

The electrical switch unit 22 comprises a housing means 33 having a chamber 34 therein which receives the switch blades 26 and 27 and is adapted to be closed by a cover plate 35.

The cover plate 35 has a cup-shaped part 36 formed integrally therewith and being adapted to pivotally mount the actuator member 30 thereto so as to be carried by the switch unit 22.

Figure 4:
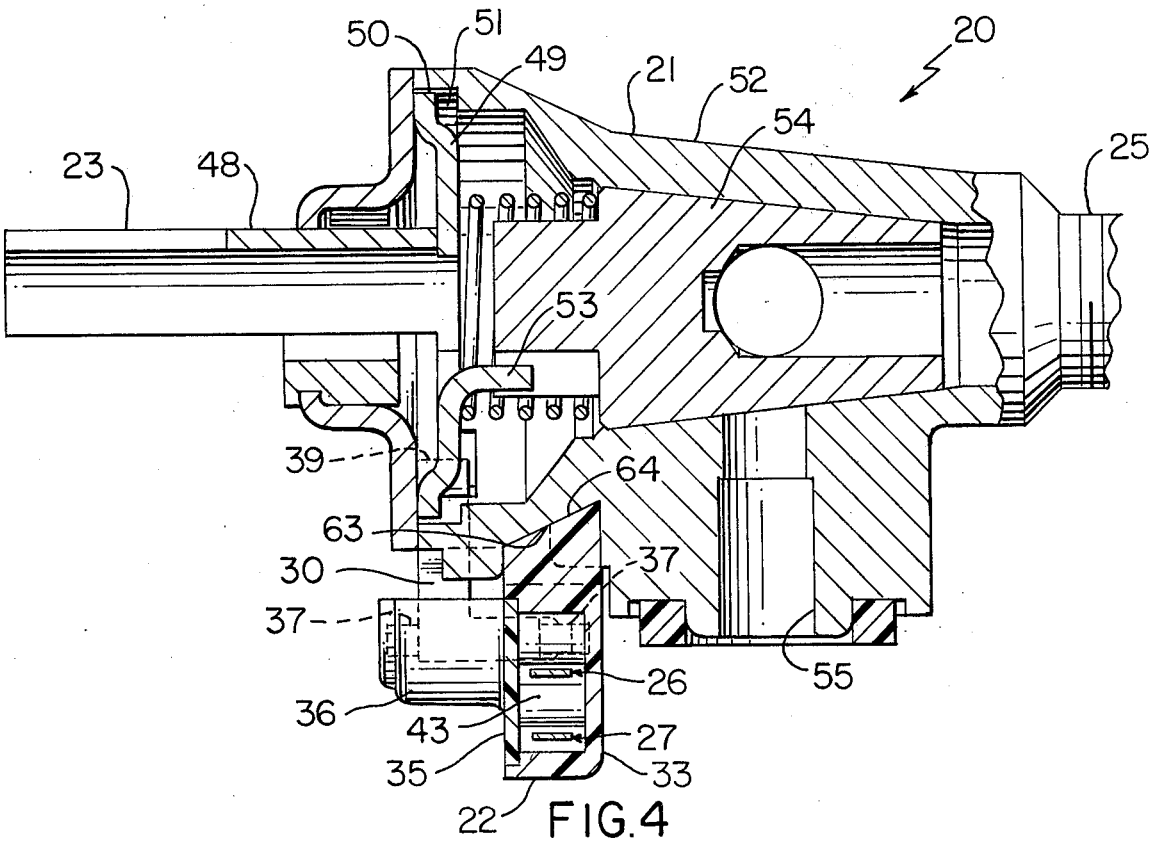
FIG. 4 is a cross-sectional view taken on line 4—4 of FIG. 3.
Figure 5:
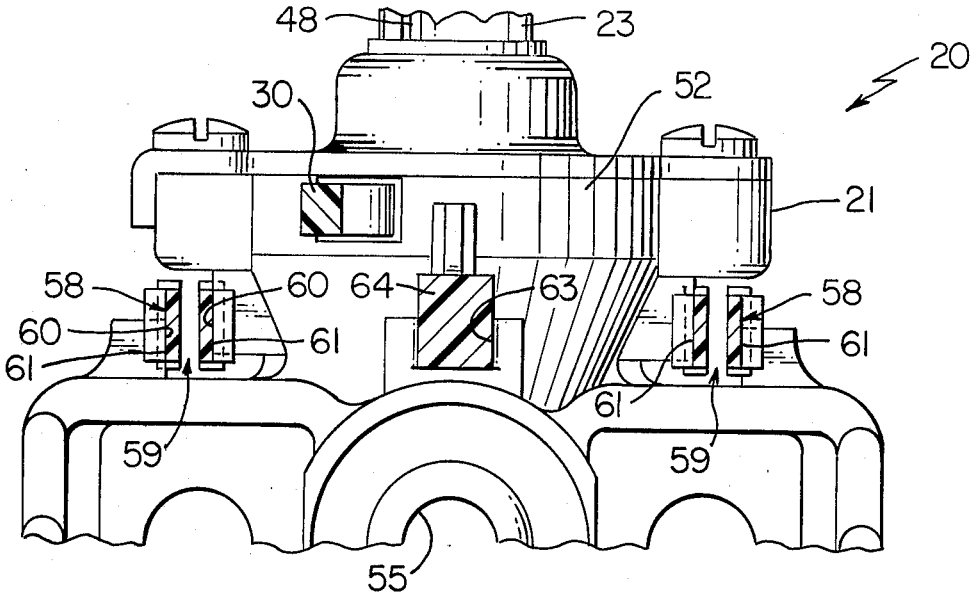
FIG. 5 is a fragmentary cross-sectional view taken in the direction of the arrows 5—5 of FIG. 3.
Figure 6:
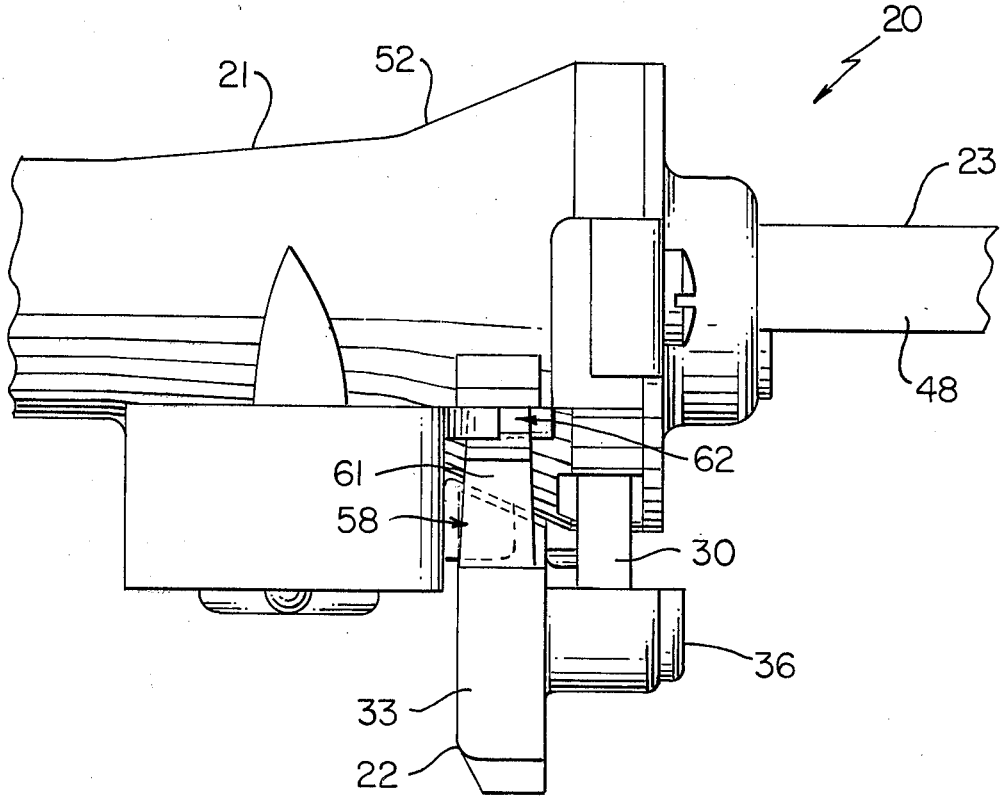
FIG. 6 is a partially broken away side view of the combination illustrated in FIG. 3 and is taken in the direction of the arrows 6—6 of FIG. 3.

In particular, the actuator member 30 comprises a bell-crank-type lever having a pivot pin-like part 37 which is pivotally mounted to the housing means 33 and the cup-shaped retainer 36 in the manner illustrated in FIG. 4 so that an arcuate arm 38 of the lever 30 can have its opposed ends 39 and 40 respectively disposed in engagement with a cam surface 41 of the selector means 23 and a looped free end 42 of the switch blade 27, the end 40 of the actuator 30 comprising an offset portion 40' extending into the chamber 34 of the housing means 33 to engage the end 42 of the switch blade 27 as illustrated.

The housing means 33 of the switch unit 22 has a cylindrical stop member 43 disposed intermediate the switch blades 26 and 27 to be engaged thereby in a manner now to be described.

The terminal portions 31 and 32 of the switch blades 26 and 27 are respectively mounted in suitable slot means 44' and 45' of the housing means 22 so that the left hand portions 46 and 47 of the switch blades 26 and 27 in FIG. 3 are disposed in cantilevered fashion and respectively have a natural bias toward the stop 43 with the bias of the switch blade 27 being greater than the bias of the switch blade 26.

In this manner, when the actuator 30 is disposed in the position illustrated in FIG. 3, the natural bias of the switch blade 27 moves the flexible portion 47 thereof upwardly against the stop 43 so that the contact portion 29 thereof makes contact with the contact portion 28 of the switch blade 26 and moves the switch blade 26 therewith upwardly out of contact with the stop 43 as illustrated in FIG. 3. However, when the actuator member 30 is moved from the position illustrated in FIG. 3 to the position illustrated in FIG. 7 in the manner hereinafter set forth, the arm end 40 of the actuator 30 moves the flexible portion 47 of the switch blade 27 downwardly and the flexible portion 46 of the switch blade 26 follows such movement until the flexible portion 46 is against the stop 43 as illustrated in FIG. 7 so that further downward movement of the switch blade 27 moves its contact portion 29 out of contact with the contact portion 28.

The selector means 23 of the device 21 includes a control knob shaft 48 carrying a drive plate 49 having an outer peripheral portion 50 rotatably mounted in an annular chamber 51 of the housing means 52 of the device 21 so that rotational movement of the shaft 48 will be imparted by a drive tang 53 of the drive plate 49 to a valve member 54 rotatably mounted in the housing means 52 and being adapted to interconnect a fuel source inlet 55 to the outlet 25 in a manner well known in the art.

Figure 7:
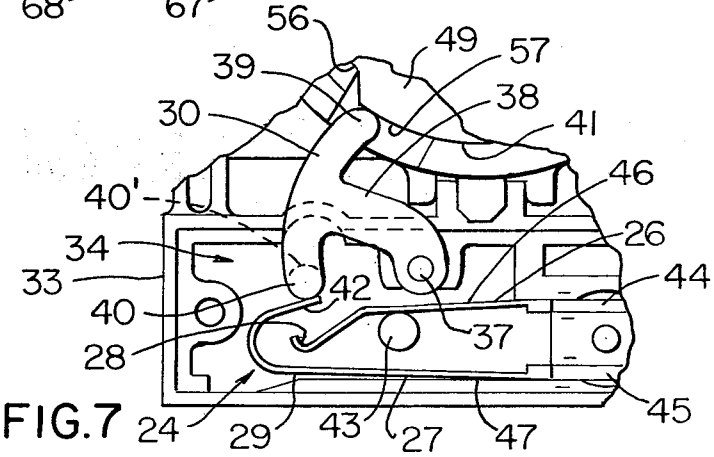
FIG. 7 is a fragmentary view similar to FIG. 3 and illustrates the switch construction in an open condition thereof.

The outer periphery 50 of the drive plate 49 defines the cam surface 41 previously described which has a low area 56 as illustrated in FIG. 3 and a high area 57 as illustrated in FIG. 7 so that when the low area 56 is disposed adjacent the end 39 of the actuator 30, the natural bias of the switch blade 27 causes the switch means 24 to assume the condition illustrated in FIG. 3 wherein the contact portions 29 and 28 are disposed in contact with each other and the switch blade 27 is against the stop 43. However, when the high portion 57 of the drive plate 49 is moved against the end 39 of the actuator member 30 in the manner illustrated in FIG. 7, the actuator member 30 is cammed in a counterclockwise direction in the drawings so that the end 40 thereof moves the switch blade 27 downwardly as previously described to open the contact portion 29 thereof from the contact portion 28 as the downward movement of the switch blade 26 is stopped by the stop means 43 as illustrated in FIG. 7.

Thus, it can be seen that by properly shaping the cam surface 41 of the drive plate 49, the switch means 24 can be opened and closed as certain sections of the cam surface 41 are disposed adjacent the end 39 of the actuator 30 to operate the electrical ignition means for the burner device 21 as desired.

As previously stated, it is a feature of this invention to provide an improved means for detachably securing the switch unit 22 to the burner valve control device 21.

In particular, the housing means 33 of the switch unit 22 is provided with a pair of upstanding legs 58 which are respectively adapted to be snap-fitted in a pair of slot means 59 defined by the housing means 52 of the burner valve control device 21.

Each slot means 59 of the burner valve control device 21 defines a pair of opposed edge means 60 and each leg 58 of the switch unit 22 is bifurcated to define two parallel sections 61 each having a notch 62 facing outwardly so that the notches 62 of the two sections 61 of each leg 58 are adapted to respectively snap-fittingly receive the adjacent edges 60 of the housing means 52 of the device 21 therein when the legs 58 are snap-fitted upwardly into the slots 59 in the manner illustrated in FIG. 3.

In this manner, the switch unit 22 is adapted to be snap-fitted to the housing 52 of the device 21 so as to be carried thereby and can be readily detached therefrom by merely squeezing together the leg sections 61 of each leg 58 so that the same can be pulled out of the slot means 59 in a simple manner.

In order to properly locate the switch unit 22 to the device 21 when the same is being snap-fitted thereto, the housing means 52 of the device 21 can be provided with locating recess means 63 adapted to receive a locating abutment 64 of the switch unit 22 therein in the manner illustrated in FIGS. 3 and 4 when the legs 58 of the switch unit 22 are snap-fitted in the slots 59 in the manner previously set forth.

As previously stated, another feature of this invention is to provide an improved switch blade for an electrical switch construction.

Therefore, it can be seen that the switch blades 26 and 27 for the electrical switch units 22 of this invention are adapted to each be uniquely formed from a one-piece member to define not only the resilient portions 46 and 47 thereof, but also the rigid terminal portions 44 and 45 thereof.

Figure 8:
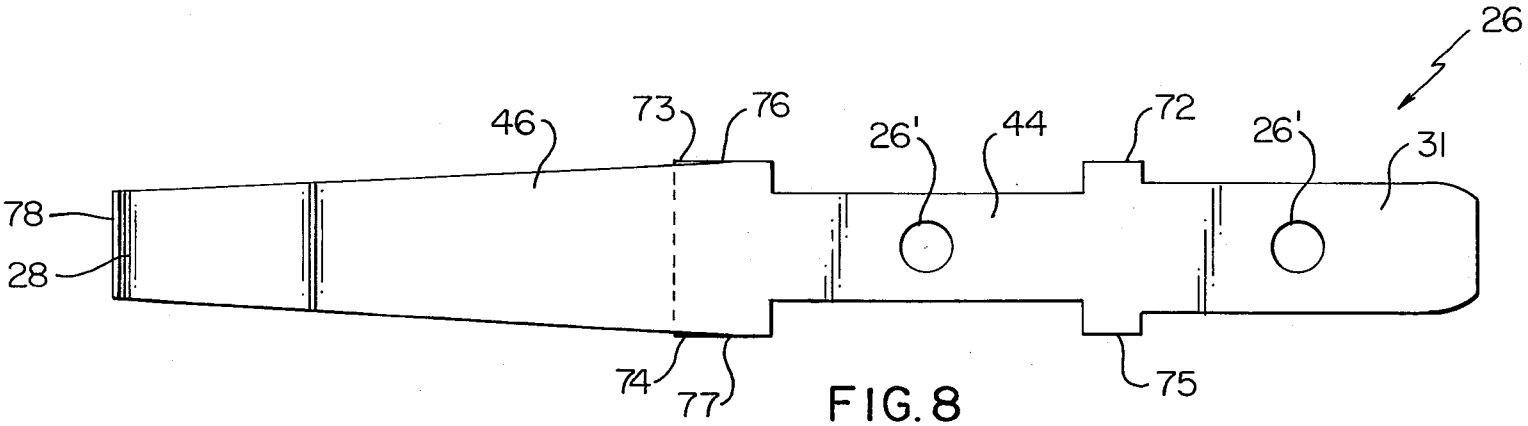
FIG. 8 is an enlarged top view of one of the switch blades of the switch construction of this invention.
Figure 9:
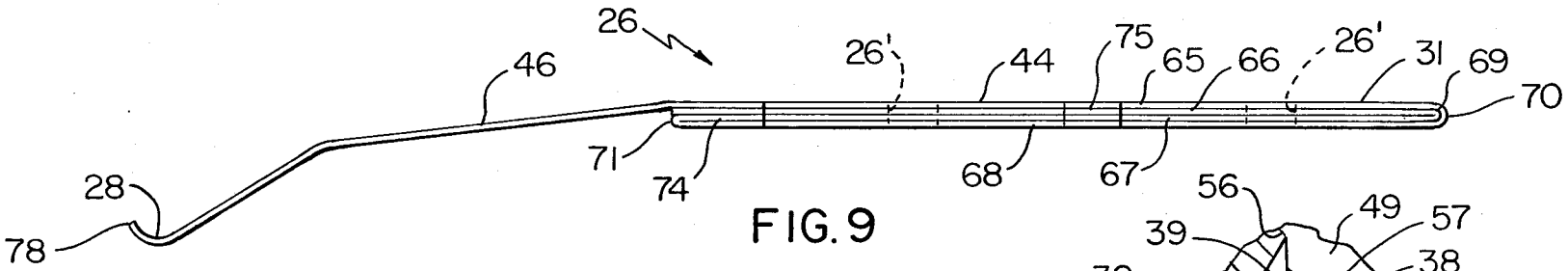
FIG. 9 is a side view of the switch blade of FIG. 8.

In particular, reference is made to FIGS. 8 and 9 wherein in the switch blade 26 is shown in enlarged form and comprises a one-piece metallic member of considerable length looped and folded upon its self to define stacked layers 65, 66, 67 and 68 respectively defined by a plurality of folds 69, 70 and 71 so that the layers 65–68 define the rigid terminal portion 44 thereof.

The stacked layers 65–68 of the switch blade 26 can be secured together in any suitable manner. For example, the stacked layers 65–68 can be riveted together by suitable rivets (not shown) being inserted in suitable openings 26' formed through the stacked layers 65–68.

As illustrated in FIG. 8, the stacked layers 65–68 are adapted to be provided with a plurality of outwardly directed tangs 72, 73, 74 and 75 to provide suitable corners for positively locating and securing the switch blade 26 in the housing means 22 in a manner well known in the art, the layer 65 of the one-piece switch blade member extending beyond the tangs 73 and 74 and tapering substantially from the medial portions 76 and 77 thereof to define the flexible portion 46 of the switch blade 26.

The contact portion 28 of the switch blade 26 is defined by arcuately bending the free end 78 thereof as illustrated in FIG. 9.

Figure 10:
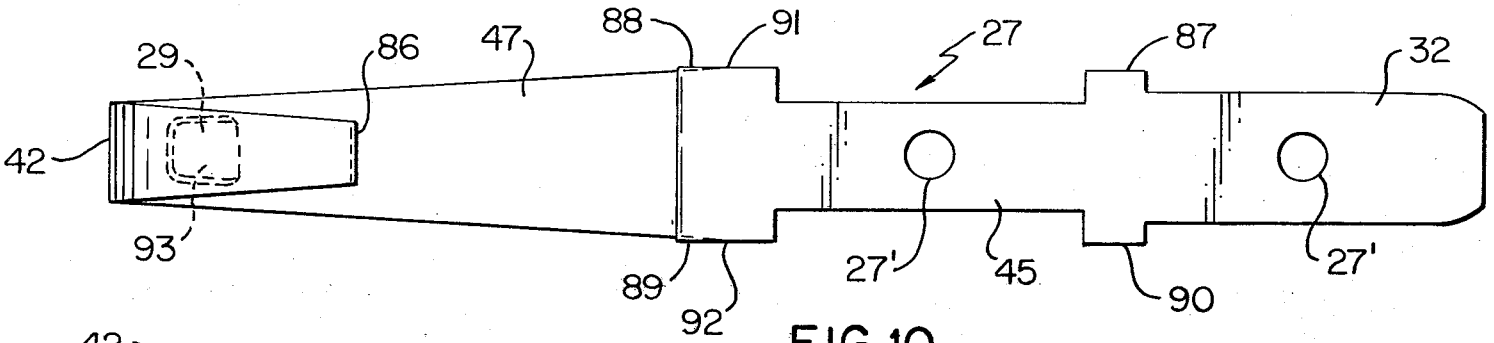
FIG. 10 is a top view of the other switch blade of switch construction of this invention.
Figure 11:
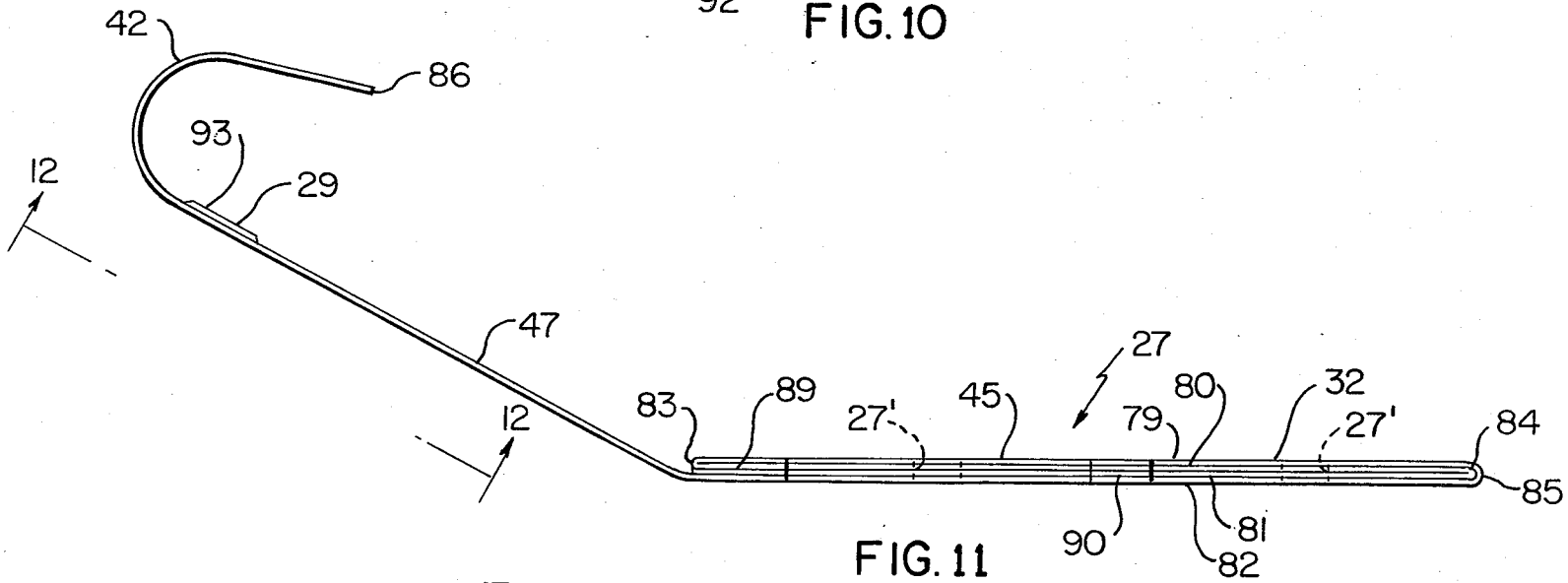
FIG. 11 is a side view of the switch blade illustrated in FIG. 10.

As illustrated in FIGS. 10 and 11, the other switch blade 27 is also formed from an elongated one-piece member folded upon itself to define a plurality of layers 79, 80, 81 and 82 defined by folded parts 83, 84 and 85 so that the layers 79–82 define the rigid terminal portion 45 of the blade 26 while the layer 82 extends beyond the rigid portion 45 to define the flexible portion 47 thereof having the loop 42 defined at the end 86 thereof, the stacked layers 79–82 being adapted to be secured together by suitable rivets (not shown) passing through the openings 27' in the stacked layers 79–82 if desired.

The terminal portion 45 of the blade 27 also has a plurality of outwardly directed tangs 87, 88, 89 and 90 for positively locating and securing the switch blade 27 in the housing means 22, the layer 82 tapering from the medial portions 91 and 92 of the tangs 88 and 89 to define the flexible portion 47 thereof as illustrated.

Figure 13:
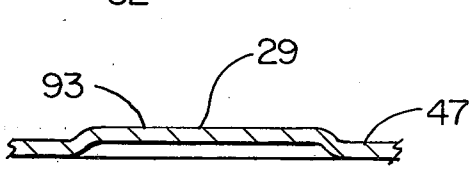
FIG. 13 is an enlarged fragmentary cross-sectional view taken on the line 13—13 of FIG. 12.
Figure 12:
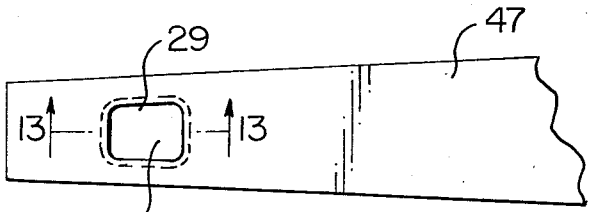
FIG. 12 is a fragmentary view of the switch blade of FIG. 11 as taken in the direction of the arrows 12—12 of FIG. 11.

The contact portion 29 of the switch blade 27 is defined by an embossed flattened substantially rectangular portion 93 thereof as illustrated in FIGS. 11, 12 and 13.

In this manner, the flattened embossed portion 93 of the switch blade 27 provides a wiping surface against which the curved contact portion 28 of the switch blade 26 will engage so that as the switch blades 27 and 26 are moved relative to each other, a sliding wiping action takes place between the curved contact portion 28 of the blades 26 and the flattened embossed portion 93 of the switch blade 27 in order to break any welds that may exist therebetween.

While the switch blades 26 and 27 have each been illustrated as being formed from an elongated length thereof folded upon itself in a longitudinal direction to define the rigid terminal portion 44 or 45 thereof, it is to be understood that the switch blade 26 or 27 could be formed by having a one-piece member folded laterally from one or both sides thereof to define a stacked layer thereof rather than from the end thereof in order to form the rigid terminal portion thereof if desired.

From the above, it can be seen that the combination of the control device 21 and switch unit 22 of this invention can be formed by the methods of this invention to operate in a manner now to be described.

After the switch unit 22 has been snap-fitted to the burner valve control device 21 by having the bifurcated legs 58 thereof snap-fitted through the slots 59 so that the locating means 64 of the housing means 33 of the switch unit 22 is disposed in the recess means 63 of the device 21, it can be seen that the arm 38 has its end 39 disposed against the cam surface 41 of the drive plate 49 while its other end 40 is disposed against the looped end 42 of the switch blade 27.

As long as a low portion 56 of the cam surface 41 is disposed against the end 39 of the arm 38 of the actuator member 30, the natural bias of the flexible portion 47 of the switch blade 27 overcomes the natural bias of the flexible portion 46 of the switch blade 26 to move the switch blade 26 upwardly therewith until the switch blade 27 is disposed against the stop 43 and the end 42 is disposed against the end 40 of the actuator 30. In this manner, the contact portions 28 and 29 of the switch blades 26 and 27 are disposed in contact with each other so that the electrical ignition system for the burner associated with the device 21 is rendered operative through the closed switch means 22.

However, when the operator rotates the selector shaft 48 of selector means 23 to another position thereof wherein a high side 57 of the cam surface 41 bears against the end 39 of the bell-crank-like member 30, the bell-crank-like member 30 is moved in a counterclockwise direction as illustrated in FIG. 7 to move the switch blade 27 out of contact with the contact portion 28 of the switch blade 26 as the switch blade 26 engages against the stop 43 to prevent further movement downwardly with the switch blade 27 so that the switch means 24 is disposed in the open position illustrated in FIG. 7 as long as the selector means 23 for the device 21 is disposed in a position that presents a high side 57 of the cam surface 41 to the actuator 30.

Therefore, it can be seen that the combination of the control device 20 and the electrical switch unit 22 of this invention is operated by the uniquely arranged bell-crank-like member 30 that is pivotally carried by the switch unit 22. Also, it can be seen that the switch blades 26 and 27 are uniquely arranged within the switch unit 22 to have the looped end 42 of the outboard blade 27 acted upon by the actuator 30 even though the actuator 30 is disposed outboard of the intermediate switch blade 26.

While the switch unit 22 has been illustrated and described as having bifurcated legs 58, it is to be understood that the switch unit 22 could have other means for providing the snap-fit arrangement with the device 21.

Figure 14:
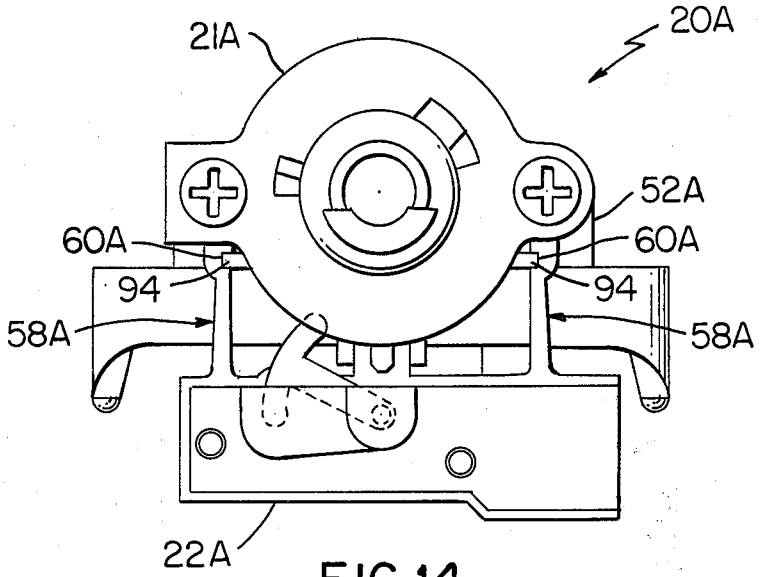
FIG. 14 is a view similar to FIG. 2 and illustrates another embodiment of the combination of this invention that comprises the burner valve control device and an electrical switch unit carried thereby.

For example, reference is made to FIG. 14 wherein another combination of this invention is generally indicated by the reference numeral 20A and parts thereof similar to the combination previously described are indicated by like reference numerals followed by the reference letter "A".

As illustrated in FIG. 14, the switch unit 22A has a pair of legs 58A extending upwardly therefrom and each has a notch 60A adapted to snap-fit over a ledge 94 of the housing means 52A of the device 21A to snap-fit the unit 22A to the device 21A.

Also, while the actuator 30 of this invention has been described as having a fixed distance between the opposed ends 39 and 40 thereof, it is to be understood that the bell-crank-like member 30 of this invention can be made adjustable to provide for variations in the assembly of the units 22 to the devices 21.

Figure 15:
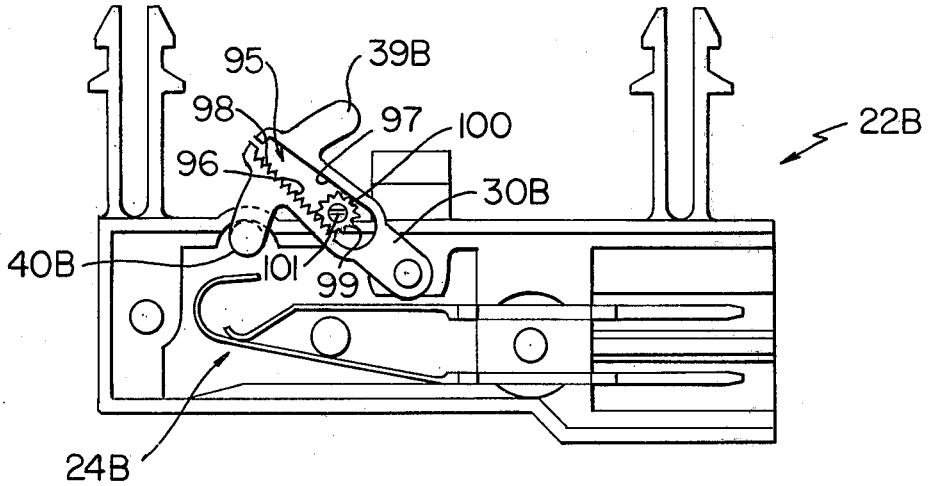
FIG. 15 is a view similar to FIG. 3 without the control device and illustrates another embodiment of the electrical switch construction of this invention.

For example, reference is made to FIG. 15 wherein another switch unit of this invention is generally indicated by the reference numeral 22B and parts thereof similar to the switch unit 22 previously described are indicated by like reference numerals followed by the reference letter "B".

As illustrated in FIG. 15, the only difference between the switch unit 22B and the switch unit 22 previously described is the actuator member 30B which is provided with a slot 95 between the opposed ends 39B and 40B thereof. The natural resiliency of the member 30B is to hold the opposed sides 96 and 97 of the slot 95 closely adjacent to each other so that the distance between the ends 39B and 40B will be at a minimum. However, the side 96 of slot 95 is provided with a plurality of teeth 98 in rack-like form which are adapted to cooperate with teeth 99 on a rotatable pinion 100 disposed in the slot 95, the side 97 of the slot 95 being smooth and converging toward the side 96 as the sides 96 and 97 approach the open end of the slot 95.

In this manner, a person can insert a screwdriver or the like in a slot 101 of the pinion 100 and rotate the same within the slot 95 so that rotation of the pinion 100 causes the pinion 100 to either climb upwardly along the teeth 98 or downwardly depending upon the rotation of the pinion 100.

Thus, as the pinion 100 is rotated in a counterclockwise direction in FIG. 15, the pinion 100 will move upwardly along the track 98 and by engaging against the smooth surface 97 of the slot 95 will cause the slot 95 to widen and thereby position the ends 39B and 40B further apart the more the pinion 100 is driven upwardly in the slot 95. Conversely, as the pinion 100 is rotated in a clockwise direction in FIG. 15, the pinion 100 will move downwardly in the slot 95 and thereby permit the opposed ends 39B and 40B to move closer to each other.

Accordingly, it can be seen that by providing the adjustable bell-crank-like member 30B, adjustment can be made between selector means of the device 21 and the switch means 24B in the switch unit 22B to compensate for any manufacturing differences therebetween so that the actuator 30B will properly operate the switch means 24B when the selector means has the particular cam surface thereof against the end 39B of the actuator 30B.

From the above, it can be seen that this invention not only provides an improved combination of a burner valve control device and an electrical switch therefor, but also this invention provides an improved electrical switch unit and parts therefor. In addition, this invention provides a method of making such an improved combination as well as methods of making an electrical switch construction and parts therefor.

While the forms and methods of this invention now preferred have been illustrated and described as required by the Patent Statute, it is to be understood that other forms and method steps can be utilized and still fall within the scope of the appended claims.

What is claimed is:

1. In a combination of a burner valve control device and an electrical switch unit carried by said device and being operated by movable actuator means controlled by the selector means of said device, said selector means comprising a control shaft rotatable about an axis thereof, the improvement wherein said switch unit has snap-fit means snap-fitted to said device when the entire said switch unit is moved in a direction substantially transverse to said axis of said control shaft to detachably secure said switch unit to said device.

2. A combination as set forth in claim 1 wherein said snap-fit means of said switch unit comprises a plurality of legs extending therefrom in a direction substantially transverse to said axis of said control shaft and each being snap-fitted to said device.

3. A combination as set forth in claim 2 wherein said device has a plurality of slot means respectively receiving said legs in a snap-fit relation therewith.

4. In a combination of a burner valve control device and an electrical switch unit carried by said device and being operated by movable actuator means controlled by the selector means of said device, said selector means comprising a control shaft rotatable about an axis thereof, the improvement wherein said switch unit has snap-fit means snap-fitted to said device when the entire said switch unit is moved in a direction substantially transverse to said axis of said control shaft to detachable secure said switch unit to said device, said snap-fit means of said switch unit comprising a plurality of legs extending therefrom in a direction substantially transverse to said axis of said control shaft and each being snap-fitted to said device, said device having a plurality of slot means respectively receiving said legs in a snap-fit relation therewith, each slot means defining a pair of opposed edge means of said device, each leg being bifurcated to define two side-by-side sections respectively snap-fitted to said pair of opposed edge means of its respective slot means.

5. A combination as set forth in claim 2 wherein said device has locating recess means therein, said switch unit having locating means disposed in said locating recess means of said device, said locating means being separate from said plurality of legs.

6. In a method of making a combination of a burner valve control device and an electrical switch unit carried by said device and being operated by movable actuator means controlled by the selector means of said device, said selector means comprising a control shaft rotatable about an axis thereof, the improvement comprising the steps of forming said switch unit with snap-fit means, and snap-fitting said snap-fit means to said device by moving the entire said switch unit in a direction substantially transverse to said axis of said control shaft to detachably secure said switch unit to said device.

7. A method as set forth in claim 6 and including the step of forming said snap-fit means of said switch unit to comprise a plurality of legs extending therefrom in a direction substantially transverse to said axis of said control shaft and each being adapted to be snap-fitted to said device.

8. A method as set forth in claim 7 and including the step of forming said device with a plurality of slot means respectively adapted to receive said legs in a snap-fit relation therewith.

9. In a method of making a combination of a burner valve control device and an electrical switch unit carried by said device and being operated by movable actuator means controlled by the selector means of said device, said selector means comprising a control shaft rotatable about an axis thereof, the improvement comprising the steps of forming said switch unit with snap-fit means, snap-fitting said snap-fit means to said device by moving the entire said switch unit in a direction substantially transverse to said axis of said control shaft to detachably secure said switch unit to said device, forming said snap-fit means of said switch unit to comprise a plurality of legs extending therefrom in a direction substantially transverse to said axis of said control shaft and each being adapted to be snap-fitted to said device, forming said device with a plurality of slot means respectively adapted to receive said legs in a snap-fit relation therewith, forming each slot means to define a pair of opposed edge means of said device, and forming each leg to be bifurcated and thereby define two side-by-side sections respectively adapted to be snap-fitted to said pair of opposed edge means of its respective slot means.

10. A method as set forth in claim 7 and including the steps of forming said device to have locating recess means therein, forming said switch unit to have locating means separate from said plurality of legs, and disposing said locating means of said switch unit in said locating recess means of said device.

* * * * *